United States Patent [19]

Anderson

[11] Patent Number: 4,646,808

[45] Date of Patent: Mar. 3, 1987

[54] CORDLOCK STRUCTURE FOR A BLIND ASSEMBLY

[75] Inventor: Richard N. Anderson, Owensboro, Ky.

[73] Assignee: Hunter Douglas, Inc., Maywood, N.J.

[21] Appl. No.: 706,432

[22] Filed: Feb. 27, 1985

[51] Int. Cl.[4] ..... E06B 9/38

[52] U.S. Cl. ..... 160/178 C; 160/84 R

[58] Field of Search ..... 160/166 R, 178 R, 178 B, 160/178 C, 173, 168 R, 84 R

[56] References Cited

U.S. PATENT DOCUMENTS

| | | | |
|---|---|---|---|
| 1,973,933 | 9/1934 | Shehan | 160/178 C |
| 2,105,082 | 1/1938 | Johnson | 160/173 |
| 3,130,776 | 4/1964 | Van Thienen | 160/178 R |
| 3,221,802 | 12/1965 | Hurkmans | 160/173 |
| 4,212,341 | 7/1980 | Fischer | 160/84 R |
| 4,425,955 | 1/1984 | Kaucil | 160/168 R |
| 4,443,915 | 4/1984 | Niemeyer | 160/178 C X |
| 4,488,588 | 12/1984 | McClure | 160/178 C |
| 4,557,309 | 12/1985 | Judkins | 160/84 R |

*Primary Examiner*—Ramon S. Britts
*Assistant Examiner*—David M. Purol
*Attorney, Agent, or Firm*—Pennie & Edmonds

[57] ABSTRACT

A cordlock structure adapted to be applied to either end of a headrail supporting a blind assembly. The structure has a base member adapted to be fixed to the headrail and a single cap member adapted to be fixed to either one of two fastening elements on the base member extending from the front and rear sides of the headrail.

The cap member includes a locking dog assembly which is moved to a cord unlocking position by moving operating cords hanging from the assembly in a direction away from the plane of the blind assembly.

The cordlock structure includes wear surfaces having superior wear properties over which the cords pass.

9 Claims, 11 Drawing Figures

CORDLOCK STRUCTURE FOR A BLIND ASSEMBLY

FIELD OF THE INVENTION

This invention relates to a cordlock structure for a blind assembly. More particularly the invention relates to a cordlock structure having a minimum of parts and which may be applied to either end and to either side of a headrail supporting the blind assembly. In addition the cordlock structure according to the invention is of a small unobtrusive size when applied to the end of a headrail and which may be operated by moving cord locking means to a locked and unlocked position by in turn moving blind operating cords away from or towards the blind assembly.

BACKGROUND OF THE INVENTION

Cordlock structures adapted to be applied to the ends of headrails for locking operating cords of a blind assembly are known where the structure comprises a base portion for fixing the structure to the end of a headrail and a cap portion containing a cord locking means where the cap extends in a direction away from the headrail. The cap and base portions conventionally comprise a single unitary member which may be molded from a plastic material. Because the structure comprises a unitary member, the cordlock structure for use with one end of a headrail is different from and is a mirror image of the cordlock structure used at the opposite end of a headrail such that the two structures are not interchangeable. This of necessity requires an inventory of two separate cordlock structures to accommodate a blind assembly where it may be desirable, or necessary because of space limitations, to have blind operating cords positioned at a particular one of the two ends of a headrail supporting the blind assembly.

Some cordlock structures have comprised separate base members and cap members containing cord locking means where the cap members may be interchanged on the base member and where the base member may be fixed to either end of a headrail to accommodate desired positioning of blind operating cords. See for example the cordlock structure as disclosed in European Patent Application Ser. No. 059,807 published Sept. 15, 1982. Even so, such structure requires use of two separate and different cap portions which are mirror images of one another in order that the cordlock structure may be positioned on either end of a headrail thus increasing inventory of cap portions.

Conventional cordlock structures often include a locking means comprising a locking dog assembly made up of a long first arm pivotally connected to the cap portion and a short arm pivotally connected to the long arm. Each arm has a locking portion on the distal end thereof adapted to lockingly engage with blind operating cords passing therebetween and the pivot axes of the two arms are positioned inside of the path of the operating cords through the cap portion with respect to the blind assembly. In some cordlock structures having this type of locking means, it is necessary in order to lower the blind assembly to pull the operating cords slightly in a vertical direction beneath the locking means, and then release the cords under control of the operator until the blind is lowered the desired amount after which the operator stops the cords with his hand and pulls the cords away from the blind assembly in order to lock the locking means.

In order to raise the blind assembly with this type of locking means, the cords are pulled either downwardly or to one side or outwardly of the blind assembly and then locked in the same manner as in lowering the blind assembly. A problem with this structure however is that if the operator accidentally releases an operating cord, except at the designated locking position where the cord is pulled away from the plane of the blind assembly, the blind assembly supported by the cord will fall to a tilted or fully down position.

Cordlock structures having the locking means as described above could be made to automatically lock when the operating cord drops or falls to a vertical position and be unlocked by moving the cords in a direction towards the plane of the blind assembly. This would require that the cap portion containing the locking means be positioned sufficiently away from the plane of the blind assembly so that there is room to move the operating cord towards the blind assembly without interferring with the blind asembly. This positioning of the cap portion a sufficient distance away from the plane of the blind assembly would result in the cordlock structure being larger than is aesthetically desirable.

Cordlock structures are conventionally made of plastic moldings and because of expense and color retention characteristics, plastics are often used which do not have good wear resistant properties. Modern blind assemblies have small diameter operating cords to improve the appearance of the blind assembly, and where the blind assembly is of substantial weight, these small diameter cords may wear and gouge into the plastic material comprising the cordlock assembly. Because of expense of material, and difficulty in coloring and color retention of some plastic materials, it often is not feasible to make the cordlock structure of highly wear resistant structure.

It is therefore an object of my invention to provide for a cordlock structure which will comprise only two parts, namely a base member and a separate cap member which may be applied to either end of a headrail and on either side of a headrail thus reducing inventory of parts.

It is a further object of my invention to provide for a cordlock structure which will have a locking means which will automatically move to a locked position when operating cords beneath the locking means are moved to a vertical position and which may be moved to an unlocked position by moving the cords away from the plane of the blind assembly.

It is a further object of my invention to provide for a cordlock structure which may comprise an inexpensive plastic material having desired color and color retention properties and which at the same time will have wear resistant surfaces to prevent wear or gouging by blind operating cords.

GENERAL DESCRIPTION OF THE INVENTION

Broadly a cordlock structure according to my invention comprises a base member which has connecting means thereon by which the base member may be fixed to either end of a headrail supporting a blind assembly. A single cap member which includes locking means for locking blind operating cords from movement is fastened onto the base member in such a manner that it may guide the operating cords in a path through the cap member and in a direction either towards or away from the plane of the blind assembly to position the locking means to a locked position. The base member has on a side opposite its connecting means two oppositely disposed first fastening means which extend beyond the end of the headrail and away from opposite sides of the headrail. The cap member has a second fastening means thereon adapted to cooperate with one of the first fastening means so that the cap member may be fastened to extend from one end of the headrail and from either side of the headrail. By this structure the single cap member along with the single base member may be affixed to either end of the headrail and to either a front side or rear side of the headrail so that in effect the single cap member may be used in four different positions with respect to the headrail.

Preferably one of the first and second fastening means comprises a flange and the other fastening means a corresponding groove in a wall portion which cooperates together to fasten the cap member to the base member.

Further it is preferable that the first and second fastening means together form a snap-lock assembly such that the cap member may be snapped into fixed position with respect to the base member. It is further preferable that the direction of snap-lock engagement be in a direction perpendicular to the direction of operating forces exerted by the operating cords in the cap member which contributes to ease of fixing of the cap member to the base member.

It is desirable that a part of the base member which is adapted to extend beyond a headrail have operating cord guide passages which are open at the top. This allows placement of the cap member to either side of the base member without the necessity of rethreading the operating cords through the base member and thus further simplifies fastening of the cap member to the base member.

Preferably the base member includes a separate wear surface associated therewith where the wear surface comprises a wear resistant material having greater wear resistant properties than the material comprising the cap member and is positioned such the operating cords pass thereover. This construction prevents the operating cords from cutting into or gouging into portions of the base member while at the same time allowing the main portion of the base member to be made of a less expensive material than that of the wear resistant surface and of a material which may have better dyeing and color retention properties. For example I have found that the main portions of the cordlock structure, namely the base member and cap member, may be made of a polycarbonate material which is relatively inexpensive and has good color retention properties and where the wear resistant surface comprises a harder material, such as nylon which is more expensive than the polycarbonate material. The wear surface may be formed as a separate insert and is placed along a cord passage extending from the base member to the cap member.

The wear surface insert preferably cooperates with the second locking means on the cap member to lock it in place with respect to the first locking means on the base member.

The cordlock structure of my invention utilizes a conventional locking dog assembly having a long first arm pivotally connected to the cap member and a short second arm pivotally connected to the first arm. Each arm is adapted to be mounted for rotational movement about an axis extending transversely to the path of the operating cords through the cap member and each arm has a locking portion on the distal end thereof such that the locking portions are adapted to lockingly engage the operating cords. The cords which are movable with respect to the plane of the blind assembly between locking and unlocking such that when the arms are pivoted to an upward position by movement of the cords, they will lock the operating cords against movement in one direction and when the arms are moved to a lower position, they will unlock the arms to allow the cords to move in two directions. This conventional locking dog assembly is installed in a cap member such that the pivot axes of the first and second arms are positioned outside of the path of the operating cords through the cap member with respect to the blind assembly. This assures that the arms may be unlocked with respect to the operating cords by moving the cords in a direction away from the blind assembly without interference with the blind assembly and also that the arms will move to lockingly engage the operating cords when the cords move or fall towards the blind assembly where they will hang vertically from the locking means. This particular construction allows use of a small cordlock construction wherein the cap member is positioned only a short distance from the plane of the blind assembly since it is not necessary to provide a large space between the locking means and plane of the blind asembly in order to move the cords towards the blind assembly to actuate and unlock the locking arms.

DESCRIPTION OF THE PREFERRED EMBODIMENTS

Figure 1:
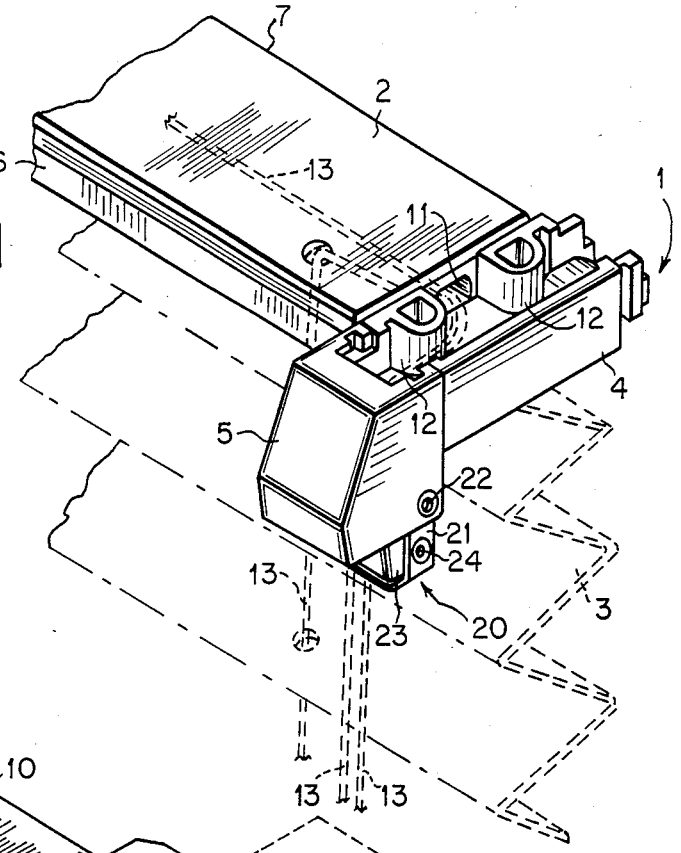
FIG. 1 is a perspective view of a cordlock construction according to the invention as applied to a headrail supporting a blind assembly.

Referring to FIG. 1 there is illustrated a cordlock structure 1 as applied to one end of a headrail 2 supporting a blind assembly 3 which may be in the form of a pleated blind, as shown, or of a conventional blind assembly having a plurality of slats.

The cordlock structure comprises a base member 4 and a separate cap member 5 which is adapted to be fixed to the base member 4 on either a front side 6 or a rear side 7 of the headrail 2.

Figure 2:
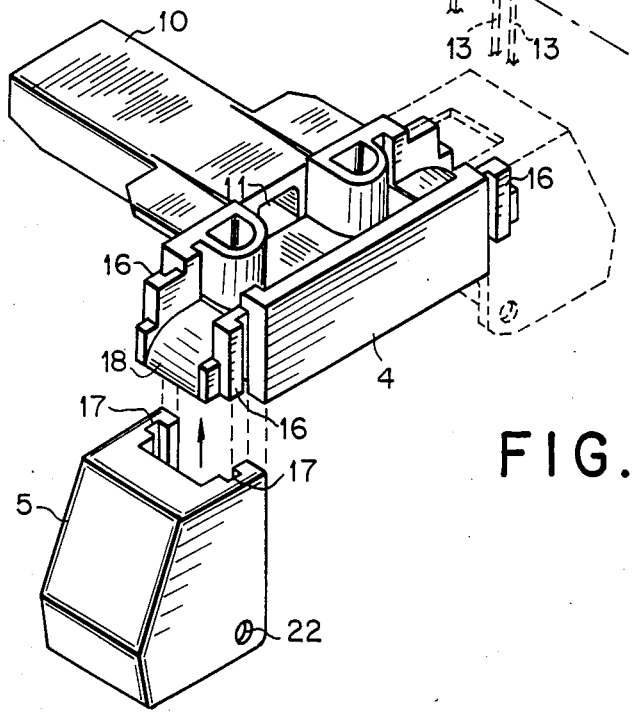
FIG. 2 is an exploded perspective view of a cordlock assembly constructed according to the invention illustrating the manner in which the structure is assembled and how a cap member may be applied to either front or rear sides of a base member.
Figure 3:
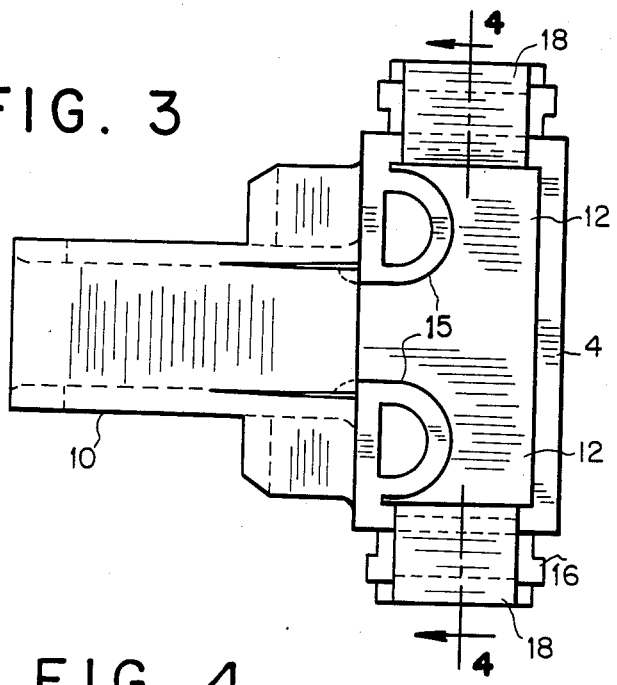
FIG. 3 is a plan view of the base member illustrated in FIG. 2.
Figure 4:
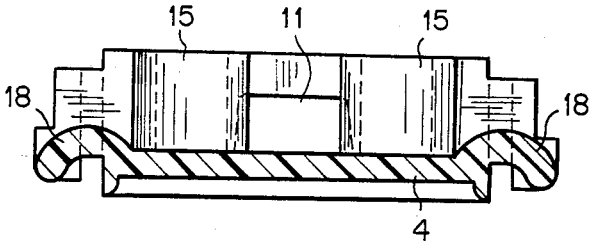
FIG. 4 is a cross-sectional view of FIG. 3 taken along lines 4—4.

The base member 4 as shown in FIG. 2 has a connecting means 10 which may be inserted into the end of the headrail 2 in order to fix the base member and the attached cap member to the headrail. The base member has a cord passage 11 extending longitudinally through the connecting means 10 and cord passages 12 extending laterally in the base member through which operating cords 13 are threaded so as to pass around guide portions 15.

Figure 5:
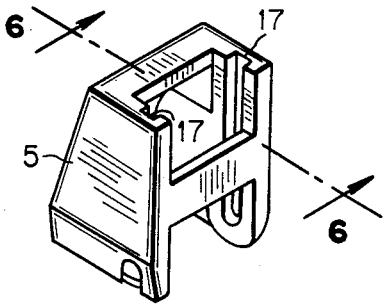
FIG. 5 is a perspective view of the opposite side of the cap member of that shown in FIG. 2.
Figure 6:
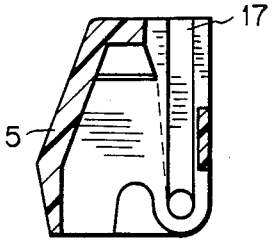
FIG. 6 is a cross-sectional view of FIG. 5 taken along lines 6—6.

The base member 4 as shown in FIG. 2 has two oppositely disposed first fastening means 16 in the form of flanges which are adapted to engage with a second fastening means 17 in the form of grooves contained in walls of the cap member as shown in FIGS. 2, 5 and 6 such that the cap member may be applied to the cap member 4 by sliding the base member in an upwardly direction such that the flanges 16 engage into the grooves 17.

The cords 13 extend through the cord passage 11 and either of the cord passages 12 over a cord engaging surface 18 on the base member 4 to extend downwardly through the cap member 5 to engage a conventional locking dog assembly 20.

Figure 8:
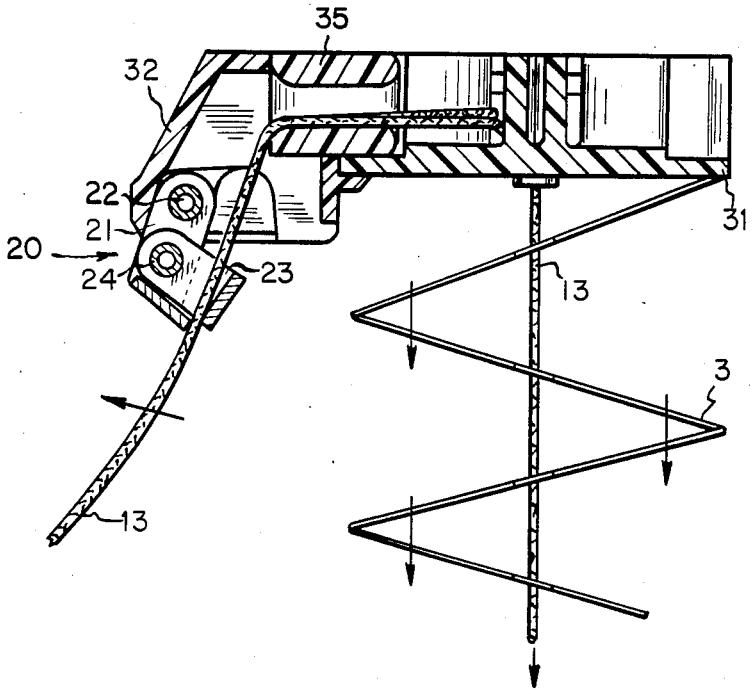
FIG. 8 is an enlarged cross-sectional view of FIG. 7 taken along lines 8—8 and illustrating movement of the locking means of the cordlock structure to an unlocked position.

The locking dog assembly 20 as shown in FIG. 1 and FIG. 8 comprises a first long arm 21 which is pivotally mounted to the base member by a pin 22. A short arm 23 is pivotally mounted to the long arm by a pin 24 and the cords 13 pass between the distal ends of the arms 21 and 23.

In order to raise the blind assembly 3, the cords 13 are pulled in a downward direction until the blind is raised to the desired height after which the cords 13 are released under operator control while being held outwardly of the blind assembly whereupon the locking dog assembly will lock the cords against further movement. In order to lower the blind assembly, the cords 13 are pulled slightly in a downward direction to unlock the locking dog assembly after which the cords are allowed to move upwardly with respect to the locking dog assembly under control of the operator until the blind is lowered to the desired position at which point the cords are released under operator control while being held outwardly of the blind assembly hereupon the locking dog assembly again operatively engages the operating cords to lock them against further movement.

As shown by reference to FIG. 2 the cap member 5 may be applied to either of the oppositely disposed fastening means 16 so that the cap member may be positioned forwardly or rearwardly with respect to the headrail 2. In some instances, as with pleated blinds that may be used as room dividers, it does not matter to a great extent whether the cap member 5 is affixed to either of the fastening means 16 since the cords may be moved towards or away from the plane of the blind assembly without interference with other structure, as for example a window pane or sash. In other installations where for example the cordlock structure is to be used with conventional blind assemblies which may have a window pane adjacent thereto, and for aesthetic reasons, it is desirable to have a cap member mounted so as to be on the front side of the headrail.

As is apparent from FIG. 1, if the cordlock structrure were applied to the opposite end of the headrail, the structure as shown in FIG. 2 must be turned 180° such that the fastening means 16 connecting with the cap member shown in dotted lines in FIG. 2 would then be positioned on the front side of the headrail rather than on the rear side as shown in FIG. 2. Thus it is seen that utilzing a separate cap member which may be affixed to either of the oppositely disposed fastening means on the base member allows the cap member to be positioned in four possible places. The result is that there is no necessity for having separate cap members of different configurations in order that they may be mounted to either end of the headrail.

Further as shown in FIGS. 1–4, the passages 12 contained in the base member 4 are open at the top. This allows a cap member having operating cords 13 threaded therethrough to be fastened to either of the fastening means 16 without the necessity of rethreading the cords through the base member.

Referring to FIGS. 7–11, in which parts like those shown in FIGS. 1–6 have like identification numerals, there is illustrated a further form of the invention having a modified cordlock structure 30 which like the cordlock structure 1 comprises a base member 31, a connection means 31' (shown in FIG. 10) and a cap member 32. The construction of the cordlock structure 30 differs mainly from that of cordlock structure 1 in the placement of the locking dog assembly 20 with respect to the blind assembly 3, in the inclusion of a wear surface insert 35 over which the operating cords pass and in the manner in which the cap member 32 is fastened to the base member 31.

Figure 7:
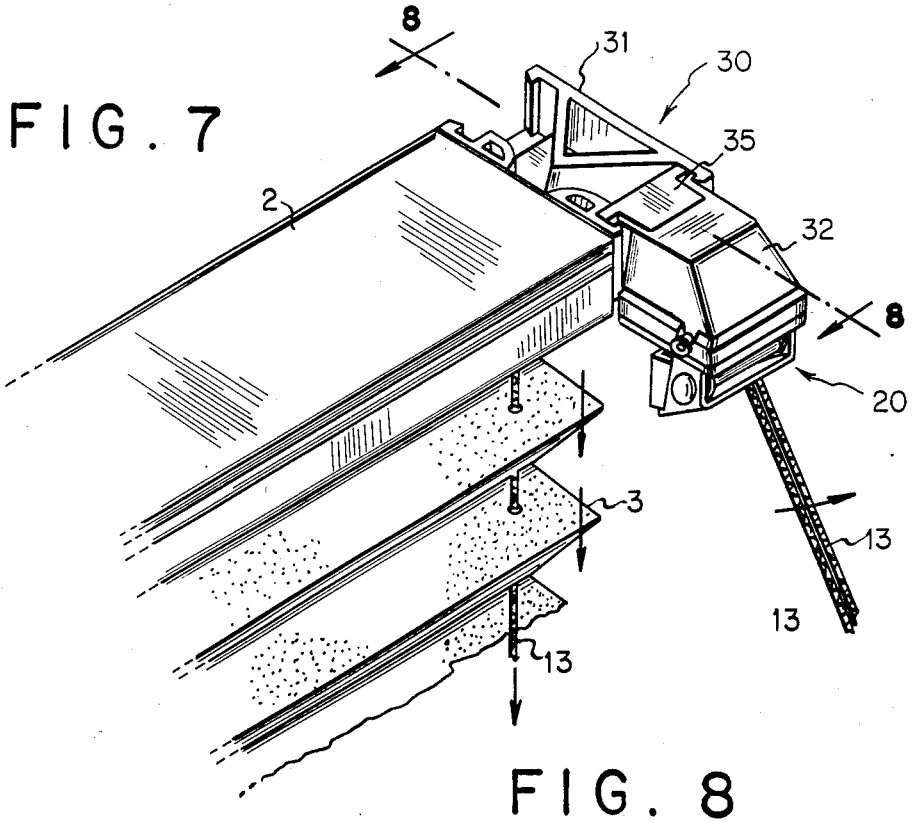
FIG. 7 is a perspective view of a further embodiment of a cordlock structure according to the invention as applied to a headrail supporting a blind assembly.

As shown in FIG. 8 the locking dog assembly 20 is the same as the conventional assembly shown in FIG. 1 in that it has a first long arm 21 which is pivotally mounted by a pin 22 to the cap member 32. A short arm 23 is connected to the long arm by pin 24 and operating cords 13 are threaded between the distal ends of arms 21 and 23. When it is desired to lower the blind assembly 3, the cords 13 are moved away from the plane of the blind assembly 3 as shown in FIGS. 7 and 8 causing the arms to unlock with respect to the cords 13 and allowing the weight of the blind assembly 3 to move downwardly with respect to the locking dog assembly. This movement of the cords 13 away from the blind assembly assures that the cords do not interfere with the blind assembly or with any window structure that might be associated with the blind assembly. This construction allows the cap member 32 to be moved close to the plane of the blind assembly thus reducing the over size of the cordlock structure and improving its appearance when applied to a headrail.

Figure 9:
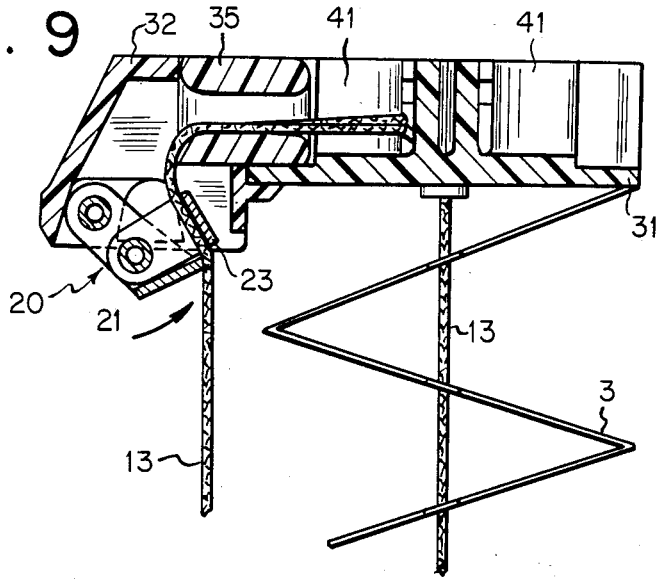
FIG. 9 is a view similar to FIG. 8 illustrating movement of the locking means to a locked position.

In order to lock the operating cords into place at the desired blind height, the operating cords are moved to the vertical position as shown in FIG. 9 which raises the arms to the position shown at which point the distal ends will lock the cords. Since the cords lock when in the vertical position as shown in FIG. 9, it is apparent that if the operator were to mistakeningly drop the cords while either raising or lowering the blind assembly, that the cords will swing into the vertical locking position as shown in FIG. 9 preventing any dropping of the blind assembly.

To raise the blind assembly, the cords 13 may be pulled vertically downwardly in the position as shown in FIG. 9 or may be pulled downwardly in the direction shown in FIG. 8 or even if in a direction towards the blind assembly.

Figure 10:
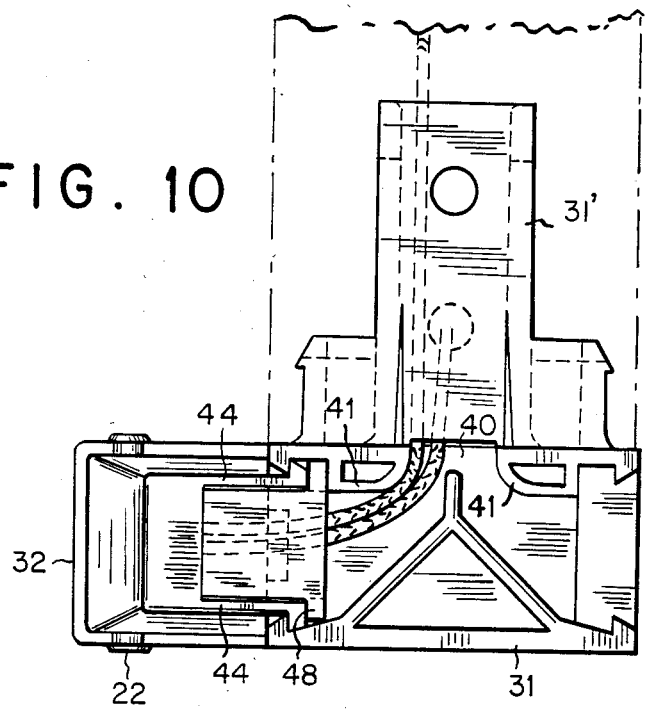
FIG. 10 is a plan view of the cordlock structure of FIG. 7.
Figure 11:
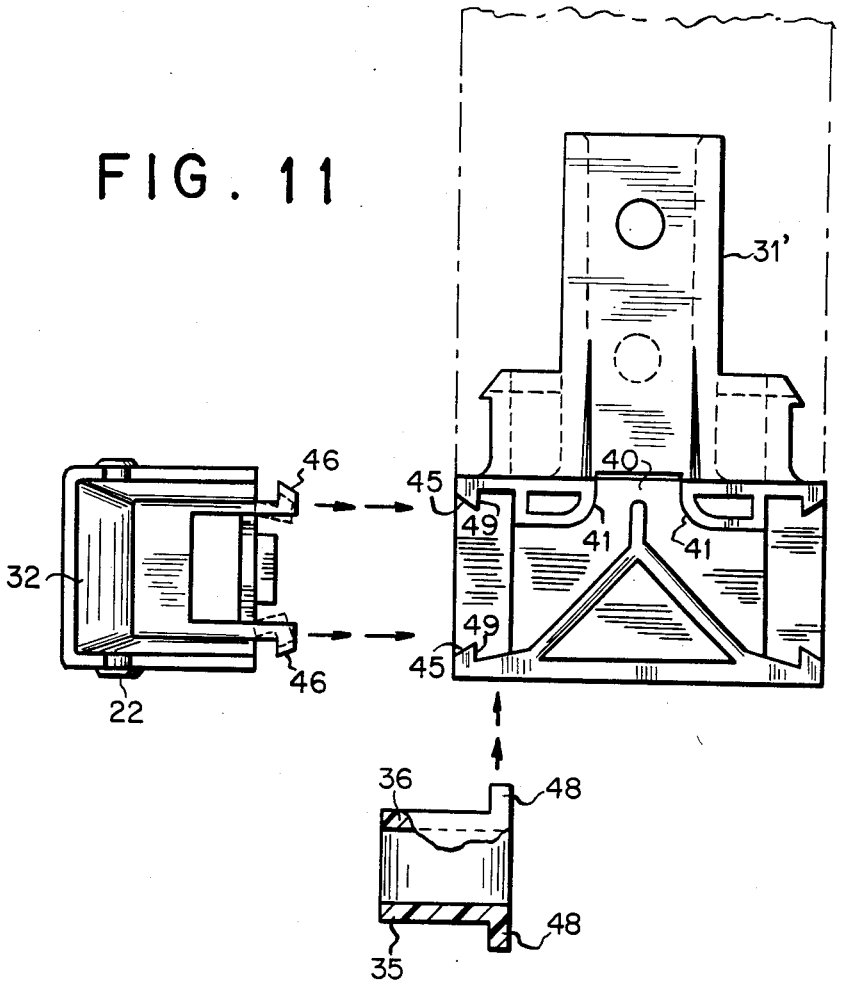
FIG. 11 is an exploded plan view of the cordlock structure shown in FIG. 10 illustrating the manner of assembly.

The wear surface insert 35 as shown in FIGS. 8, 10 and 11 comprises a hollow member, a portion of which is adapted to fit into the base member 31 and extend into the cap member 32 such that the cords 13 pass over the insert and help guide the cords 13 into contact with the locking dog assembly. While the insert as shown is generally annular in form, it could if necessary include extensions to form a further guide to guide the operating cords from the longitudinally extending passage 40 contained in the base member and to guide the cords in a lateral direction with respect to the base member. Such an extension would in effect replace the guide surfaces 41 as shown in FIGS. 10 and 11 which may be subjected to wear by contact with the operating cords.

The cap member 32 has flexible or resilient flanges 44 which are adapted to be snapped into place by moving the cap member in the direction shown in FIG. 11 towards the base member such that tapered surfaces 45 contained on the base member engage tapered surfaces 46 on the flanges to move the flanges inwardly as shown in dotted lines in FIG. 11 so that they snap into place upon moving beyond the surfaces 45.

The wear resistant insert 35 is then adapted to be moved downwardly onto the top of the base member so that the rim 48 will, as shown in FIG. 10, slide in between the end of the flanges 44 and base member 31. The tubular portion 36 of the insert will then prevent the flexible flanges 44 from being moved inwardly towards one another thus preventing their ends from disengaging from the shoulders 49 contained on the base member. The insert 35, in addition to providing a wear resistant surface, in addition provides a lock to prevent the cap member from becoming separated from the base member.

As shown in FIGS. 10 and 11, the base member has an open top so that it is not necessary to rethread the operating cords from the blind assembly through the base member upon movement of the cap member to either side of the base member.

It is seen that a cordlock construction as disclosed in the drawings provides a structure having a minimum of parts and which may be applied in various positions to a headrail. It is further seen that in one form of the cordlock construction, that the locking dog assembly is positioned to assure that the assembly may be easily unlocked by moving operating cords away from the plane of the blind assembly. Further it is seen from the drawings that a cordlock construction is provided which may utilize inexpensive material and that surfaces over which cords engage and pass may comprise more expensive wear resistant surfaces to accommodate wear caused by operating cords contacting portions of the cordlock structure.

I claim:

1. A cordlock structure for a blind assembly where said cordlock structure is adapted to be mounted to a headrail of the blind assembly, said headrail having opposite ends and opposite front and rear sides extending between the ends and where said structure includes a base member comprising connecting means for fixing said structure to one of two ends of the headrail and a cap member including cord locking means for locking blind operating cords from movement, said structure in mounted position adapted to guide said operating cords in a path through the cap member in a direction towards or away from the blind assembly to move said locking means to a locked position; characterized in that said base member and said cap member are formed as two separate parts, in that said base member has cord guide means for guiding the operating cords to either the front or rear side of said headrail and, spaced from its connecting means, has two oppositely disposed and oppositely facing first fastening means extending beyond an end of the headrail and away from opposite front and rear sides of the headrail, and in that said cap member has a second fastening means adapted to fasten with one of said first fastening means whereby said cap member may be fastened to extend from either of the front or rear sides of the headrail.

2. A cordlock structure according to claim 1 further characterized in that one of said first and second fastening means comprises a flange and the other fastening means comprises at least one corresponding groove in a wall portion cooperating to fasten said cap member to said base member.

3. A cordlock structure according to claim 2 further characterized in that said first fastening means and said second fastening means together form a snap-lock assembly.

4. A cordlock structure according to claim 3 further characterized in that said snap-lock assembly is adapted such that movement of the fastening means into a snap-lock engagement is in a direction perpendicular to the direction of operating forces exerted by the operating cords on the cap member.

5. A cordlock structure according to claim 1 further characterized in that a part of said base member adapted to extend beyond a headrail has operating cord guide passages open at the top to allow fastening of the cap member to either side of the headrail with the operating cords already extending through the cap member.

6. A cordlock structure according to claim 1 further characterized in that said cap member has a separate wear surface associated therewith comprising a wear resistant material having greater wear resistant properties than material comprising said cap member and wherein said operating cords are adapted to pass over said wear resistant material.

7. A cordlock structure according to claim 6 further characterized in that said wear surface is formed by a separate insert positioned along a cord passage extending from the base member to the cap member.

8. A cordlock structure according to claim 7 where a portion of said insert is adapted to cooperate with said second fastening means to lock said second fastening means in place with respect to said first fastening means.

9. A cordlock structure according to claim 1 wherein said locking means comprises a locking dog assemby having a long first arm pivotally connected to said cap member and a short second arm pivotally connected to said first arm, each said arm adapted to be mounted for rotational movement about an axis extending transversely to the path of the operating cords through the cap member, said arms each having a locking portion on the distal end thereof, both locking portions being adapted to lockingly engage operating cords movably guided therebetween, whereby said arms when pivoted to an upper position will lock said operating cords against movement in one direction and whereby when arms are moved to a lower position will unlock to allow said operating cords to move in two directions, further characterized in that the pivot axes of the first arm and second arm are positioned outside of the path of the operating cords through the cap with respect to the blind assembly.

* * * * *